US006677093B2

(12) United States Patent
Yoshino et al.

(10) Patent No.: US 6,677,093 B2
(45) Date of Patent: Jan. 13, 2004

(54) ELECTROPHOTOGRAPHIC BLACK TONER, ELECTROPHOTOGRAPHIC DEVELOPER AND IMAGE FORMING METHOD

(75) Inventors: Susumu Yoshino, Minamiashigara (JP); Tetsuya Taguchi, Minamiashigara (JP); Koutarou Yoshihara, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/941,560

(22) Filed: Aug. 30, 2001

(65) Prior Publication Data

US 2002/0076635 A1 Jun. 20, 2002

(30) Foreign Application Priority Data

Nov. 1, 2000 (JP) ..... 2000-334292
Dec. 26, 2000 (JP) ..... 2000-395493

(51) Int. Cl.[7] ..... G03G 9/083

(52) U.S. Cl. ..... 430/106.2; 430/111.4; 430/126

(58) Field of Search ..... 430/106.2, 111.41, 430/111.4, 126

(56) References Cited

U.S. PATENT DOCUMENTS 6,130,017 A * 10/2000 Hayashi et al. ..... 430/106
6,203,958 B1 * 3/2001 Oya et al. ..... 430/110

FOREIGN PATENT DOCUMENTS

| | | |
|---|---|---|
| EP | 0 945 766 A2 | 9/1999 |
| EP | 0 952 494 A2 | 10/1999 |
| JP | A 1-101560 | 4/1989 |
| JP | A 1-105264 | 4/1989 |
| JP | A 3-56973 | 3/1991 |
| JP | A 4-142561 | 5/1992 |
| JP | A 6-67471 | 3/1994 |
| JP | A 9-138527 | 5/1997 |
| JP | A 10-39546 | 2/1998 |
| JP | A 10-279314 | 10/1998 |
| JP | 11-338191 | 12/1999 |
| JP | 2000-10344 | 1/2000 |

* cited by examiner

*Primary Examiner*—John Goodrow
(74) *Attorney, Agent, or Firm*—Oliff & Berridge, PLC

(57) ABSTRACT

An electrophotographic black toner comprising a colorant and a binder resin, wherein the toner has a metal oxide as the colorant of 20% by weight or less, said metal oxide having magnetization of 40 emu/g or smaller, and said toner has color coordinates such that L* has a value of 10 to 25, a* has a value of −3.0 to 3.0, and b* has a value of −3.0 to 3.0 as determined by a fixed image formed with the toner, as well as an electrophotographic developer and an image forming method using said electrophotographic black toner are provided. According to the present invention, the electrophotographic black toner having a high volume-specific resistance value, achieving a sufficient degree of blackness, less likely to cause high background and providing a high quality image can be obtained.

20 Claims, 2 Drawing Sheets

ELECTROPHOTOGRAPHIC BLACK TONER, ELECTROPHOTOGRAPHIC DEVELOPER AND IMAGE FORMING METHOD

BACKGROUND OF THE INVENTION

1. Field of the Invention

The present invention relates to an electrophotographic black toner for use in an image forming method applied to a copying machine and a printer which utilize or apply an electrophotographic process, as well as to an electrophotographic developer and an image forming method using said electrophotographic black toner. More particularly, the present invention relates to an electrophotographic black toner for use in a multicolor image forming method applied to a digital copier which forms a latent image with a laser beam, as well as to an electrophotographic developer and an image forming method using said electrophotographic black toner.

2. Description of the Related Art

In an electrophotographic developing process, a black toner comprising a dispersion of a non-magnetic black pigment such as carbon black in a binder resin is widely used as a developer. In conventional electrophotographic processes, the methods for developing and making visible a latent image formed on a photoconductive photosensitive material with a toner are generally classified into two-component developing methods and one-component developing methods. In the two-component developing methods, friction is caused between a black toner and a carrier to induce an opposite charge on the black toner, allowing adhesion of the black toner to a surface having a latent image by electrostatic attraction, whereby the latent image is developed. On the other hand, in the one-component developing methods, a thin toner layer is formed on a developing roll to cause a latent image to become visible. Since the one-component developing methods which require no carrier obviate the need for controlling the density of black toner in the developer, developing devices used in these methods are simple in structure and can be made compact. However, advanced techniques are required for the one-component developing methods to achieve performances equal to those attained by the two-component developing methods. As one of the one-component developing methods, there is known a so-called insulating non-magnetic toner development in which a magnetic particulate powder is not used but an insulating or highly resistant black toner, comprising a dispersion of a fine-particulate carbon black powder in a binder resin, is used.

In the currently most common PPC-type copier, a black toner for use in the two-component developing methods and the insulating non-magnetic toner development, both described above, is required to be insulating or highly resistant and have a volume-specific resistance value of $10^{12}$ Ω·cm or higher.

As stated above, the volume-specific resistance value of $10^{12}$ Ω·cm or higher is essential for the insulating or highly resistant black toner so as to retain the charge level high enough to develop the latent image. When the volume-specific resistance value is low, the toner may not retain an appropriate amount of charge because the charge is leaked away from the toner. Also the amount of charge may decrease because a charge of an opposite polarity may be induced. To suppress these phenomena, the insulating or highly resistant black toner is strongly required to achieve a volume-specific resistance value of $10^{12}$ Ω·cm or higher so that an appropriate amount of charge can be retained. If the amount of charge is small, attraction between a toner and a carrier is weak, and therefore in such cases as where a development area undergoes stirring or a mechanical impact is generated on a photosensitive material, the toner detaches from the carrier to thereby cause high background. In contrast, if the amount of charge is large, the toner tends to remain in the vicinity of the carrier whereby a decreased amount of toner migrates to the photosensitive material to lower the image density.

It is important for the carrier used in the two-component developing methods to be such that appropriate chargeability (in view of the amount and distribution of charge) is imparted to the toner, the toner retains suitable chargeability for long periods, and the toner is maintained such that the chargeability is not changed even when humidity and temperature change. To this end, various coated carriers which are surface coated with a resin has been proposed. Further in recent years, in order to achieve a higher quality image and improve reproducibility of a solid image, it has been proposed in Japanese Patent Laid-Open (JP-A) Nos. 1-101560 and 1-105264 to disperse a conductive material in a coating film to reduce the volume-specific resistance value of the carrier. However, if the volume-specific resistance value of the carrier is decreased, the resistance of a developer in which a mixture of a toner and the carrier exists is also decreased, whereby an opposite charge (a polarity opposite of the suitable polarity of the toner) is induced on the toner by the electrical field via the carrier during development. As a result, high background occurs since chargeability of the toner is lowered or polarity of the toner is opposite of the suitable polarity. To make matters worse, another problem arises that a copy produced by a copying machine first used after the machine was left unused overnight induces high background since charge leakage occurs and consequently the amount of charge is decreased.

As described above, in order to retain the charge level, the insulating or highly resistant black toner is required to achieve a sufficient insulating property, specifically, a volume-specific resistance value of $10^{12}$ Ω·cm or higher is required. In other words, even when a larger amount of black pigment is included in a black toner to enhance blackness, the black toner is required to suppress lowering of the charge level. That is, in order to maintain the volume-specific resistance value of the black toner as high as possible, the black pigment is also required to have a volume-specific resistance value as high as possible.

Currently, as the black pigment, a fine-particulate carbon black powder is mainly used in the black toner (see JP-A Nos. 4-142561 and 10-39546). However, when the fine-particulate carbon black powder was used to prepare a black toner having a volume-specific resistance value of $10^{12}$ Ω·cm or higher, there arose a problem that because the powder exhibited conductivity, the amount of it used was limited and a sufficient degree of blackness could not be obtained. Since the fine-particulate carbon black powder is conductive by itself and has a volume-specific resistance value of $10^{12}$ Ω·cm or smaller, when a large amount of the powder is used to enhance blackness, the volume-specific resistance of the black toner is decreased, making use as the insulating or highly resistive toner impossible. Further, although details are not yet elucidated, the toner containing a fine-particulate carbon black powder allows leakage of a relatively large amount of charge as described above, and is likely to cause high background even when the toner has the volume-specific resistance value of $10^{12}$ Ω·cm or higher. When the toner surface is viewed microscopically, it can be presumed that this is caused because the carbon black itself is conductive, and thus the charge of toner easily migrates.

Another example of black pigment used in a black toner is a hematite particulate powder containing Mn (see JP-A No. 10-279314). This particulate powder has a high volume-specific resistance value of $1\times10^6$ to $1\times10^8$ Ω·cm. However, its hue which ranges from reddish brown to dark brown does not achieve a sufficient degree of blackness. Even when formed into a toner, the hematite particulate powder exhibits a similar hue, and does not obtain a sufficient degree of blackness. If the toner contains a large amount of the hematite particulate powder, a certain degree of blackness can be obtained, but the volume-specific resistance value of the toner decreases.

Some proposals have been made to produce a toner in which carbon black and magnetite particles (having a hematite structure) are co-existent (see JP-A Nos. 3-056973, 6-067471, and 9-138527). JP-A Nos. 3-056973 and 9-138527 disclose a toner produced by using particles having a strong magnetic force, aiming at prevention of toner scattering from a developer holding member by increasing a constraining force between a carrier and the toner, and the force between the developer holding member and the toner. However, in such a toner, magnetic force is too strong and the amount of toner necessary to develop the image is decreased. JP-A No. 6-067471 discloses a toner whose chargeability has been improved. However, since the toner contains carbon black, the above-described charge leakage occurs when the toner is left unused, i.e., the charge level lowers even if the toner and carrier bear sufficient charge. Due to the above, for example, a first copy left overnight has a problem that high background occurs.

In the case of the two-component developer used in the two-component developing methods, since stirring is provided to a toner and the carrier to triboelectrically charge the toner, the amount of triboelectric charge of the toner can be controlled to a certain extent by selecting properties of the carrier and stirring conditions. Therefore, reliability in image quality is high and excellent. However, since the fine-particulate carbon black powder permits leakage of a relatively large amount of charge as described above, the toner produced using the fine-particulate carbon black powder tends to induce high background. This tendency is particularly notable when the toner is used in combination with a carrier having a relatively low resistance.

Therefore, there exists a great need for a black pigment which has a volume-specific resistance value high enough to be usable in a black toner and can suppress lowering of the charge level of black toner even when the toner contains a large amount of the black pigment. However, such a black pigment exhibiting such properties has not yet been obtained.

SUMMARY OF THE INVENTION

Therefore, an object of the present invention is to offer a solution to the above-described problems of the prior art and achieve the following goals. That is, the objects of the present invention are to provide an electrophotographic black toner which has a high volume-specific resistance value, exhibits a sufficient degree of blackness, is less likely to cause high background, and produces a high quality image, as well as to provide an electrophotographic developer and an image forming method using said electrophotographic black toner.

Through intensive research, the present inventors have solved the above-described problems. That is, the present invention provides the following <1> to <3>.

<1> An electrophotographic black toner comprising a colorant and a binder resin, wherein the toner has a metal oxide as the colorant of 20% by weight or less, said metal oxide having magnetization of 40 emu/g or smaller, and said toner has color coordinates such that $L^*$ has a value of 10 to 25, a* has a value of −3.0 to 3.0, and b* has a value of −3.0 to 3.0 as determined by a fixed image formed with the toner.

<2> An electrophotographic developer comprising an electrophotographic black toner and a carrier, wherein the electrophotographic black toner described in <1> above is used.

<3> An image forming method comprising: a charging step for charging the surface of a latent image holding member uniformly; an exposing step to form an electrostatic latent image on the latent image holding member; a developing step for developing the electrostatic latent image with a developer on a developer holding member to form a toner image; a transferring step for transferring the toner image onto a transfer member; and a fixing step for fixing the toner image to the transfer member; wherein the electrophotographic black toner described in <1> above is used.

DESCRIPTION OF THE PREFERRED EMBODIMENTS

Figure 1:
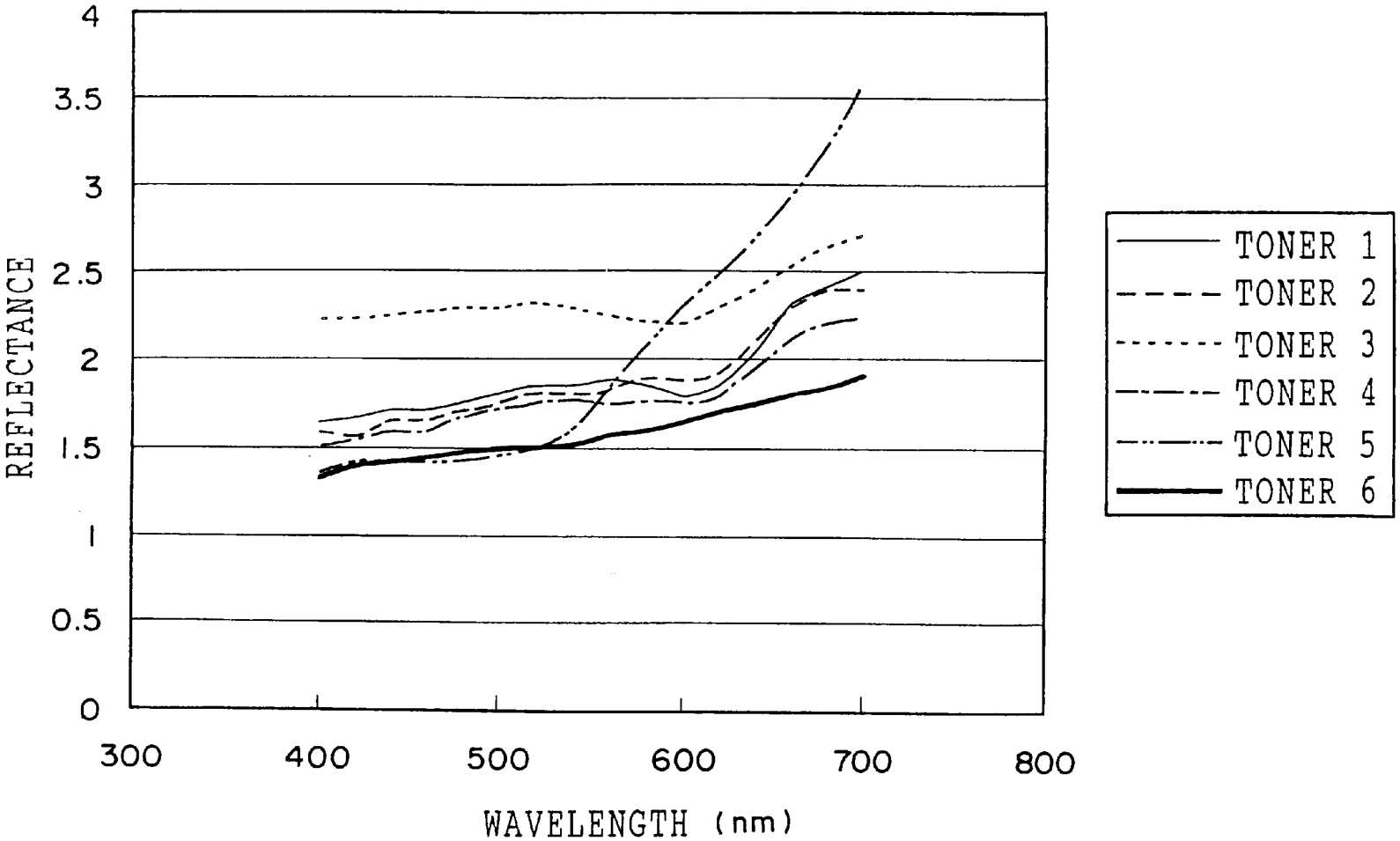
FIG. 1 is a graph showing spectral reflectances of solid images formed with the toners 1 to 6 in the Examples.

An electrophotographic black toner, an electrophotographic developer and an image forming method according to the present invention are described in detail below.

Electrophotographic Black Toner

An electrophotographic black toner of the present invention comprises toner particles containing at least a colorant and a binder resin, and additives. The toner particles contain, as colorants, particles having a hematite structure and a pigment which has a maximum peak of spectral reflectance in a range that excludes 600 nm to 700 nm.

By providing a toner in which particles having a hematite structure and a high volume-specific resistance value of $10^5$ Ω·cm or higher are coexistent with a pigment which has a maximum peak of spectral reflectance in a range that excludes 600 nm to 700 nm, a black toner can be obtained which has a volume-specific resistance value of $10^{12}$ Ω·cm or higher and achieves a sufficient degree of blackness. Since this black toner exhibits little magnetic property, it can be readily used in the two-component developer.

The particles having the hematite structure themselves have a hue ranging from reddish brown to dark brown. If this is explained in terms of spectral reflectance of the particles, it means that the reflectance in the wavelength region above 500 nm is higher than the reflectance in the wavelength region below 500 nm. This is a physical property resulting from its structure. By doping metal atoms such as Mn or the like to the particles having the hematite structure, a black hue is slightly improved, and thus made preferable, but this is not sufficient. On the other hand, as measured in the wavelength region from 400 nm to 700 nm, if a pigment which has a maximum peak of spectral reflectance in a range that excludes 600 nm to 700 nm is included in the toner simultaneously with the particles having the hematite structure, then the toner acquires an improved hue over the hue ranging from reddish brown to dark brown, which is exhibited by the particles having only the hematite structure, and further achieves a sufficient degree of blackness.

Developing methods for making an electrostatic latent image formed on a photoconductive photosensitive material visible by using a toner includes two-component developing methods and one-component developing methods. In the case of a two-component developer used in the two-component developing methods, since a toner and a carrier are stirred to triboelectrically charge the toner, the amount of triboelectric charge of the toner can be controlled by selecting properties of the carrier and stirring conditions. Therefore, reliability in image quality is high and excellent. Thus, in view of the reliability in image quality, a developer for use in the present invention is preferably the two-component developer composed of a carrier and a toner. Since reproducibility of a solid image is good when an electric resistance value of the carrier is within a range from $1\times10^8$ to $1\times10^{15}$ Ω·cm, an electric resistance of the carrier for use in the present invention is preferably in the range from $1\times10^8$ to $1\times10^{15}$ Ω·cm.

The fine particulate carbon black powder described above induces a relatively large charge leakage, and a toner using the powder tends to cause high background. This tendency is more notable when the toner is used in combination with the carrier having a relatively low resistance described above. However, since the colorant contained in the toner having the structure according to the present invention exhibits high resistance, high background can be inhibited to occur even when the toner is used in combination with the carrier having a relatively low resistance.

The particles having the hematite structure according to the present invention are characterized in that the particles have an average particle diameter of 0.02 to 2 μm. If the average particle diameter is smaller than 0.02 μm, dispersion of the particles is difficult since they are minute. If the average particle diameter is larger than 2 μm, it is difficult for the particles to achieve a sufficient degree of blackness. A volume-specific resistance value of the particles is generally $10^5$ Ω·cm or higher (100 V/cm·h). The particles may be that of an isotropic particulate powder having a sphericity (a ratio of the average diameter of the longest portion to the average diameter of the shortest portion) of less than 2, such as spherical, octahedral, hexahedral, granular particles, or the like, or that of an anisotropic particulate powder having an axis ratio (a ratio of the average major axis diameter to the average minor axis diameter) of 2 or more, such as acicular, spindle-shaped, rice granular particles, or the like.

In the present invention, the particles having the hematite structure are effective as they are. However, the particles which have the hematite structure and contain Mn are more effective since the toner has a hue of near black. The Mn content is 5 to 40% by weight of the particles having the hematite structure. If the Mn content is less than 5% by weight, it is difficult to obtain desired blackness. If the Mn content is more than 40% by weight, desired blackness can be obtained. Therefore, there is no need for adding excessive Mn since the blackness is saturated. The Mn content is preferably 9 to 35% by weight, more preferably 10 to 20% by weight.

Octahedral particles containing Mn, which have the hematite structure and an average particle diameter of 0.05 to 2.0 μm and comprises iron as the main component, are obtained in the following manner. An aqueous ferrous salt solution is allowed to react with an aqueous alkali hydroxide solution containing 1.01 to 1.3 equivalent of alkali hydroxide based on one equivalent of $Fe^{2+}$ in the aqueous ferrous salt solution, to give a suspension containing ferrous hydroxide colloids. The suspension is aerated with an oxygen-containing gas while being heated within a temperature range from 45 to 100° C. (to effect a magnetite forming reaction) so that the ferrous hydroxide colloids are oxidized to form magnetite particles, whereby a suspension containing the magnetite particles is produced. Then, an aqueous solution of Mn or Mn and $Fe^{2+}$ is added to the suspension containing the magnetite particles so that 8 to 150 atomic percent of Mn is contained relative to the total Fe in the solution. Thereafter, the suspension is heated and oxidized under the same conditions as those for the magnetite forming reaction to coat the surface of the magnetite particles with a hydroxide of Mn or hydroxides of Mn and Fe. Then, the magnetite particles coated with the hydroxide of Mn or the hydroxides of Mn and Fe are filtered, washed with water, dried, and calcined within a temperature range from 750 to 1000° C.

Spherical particles containing Mn, which have the hematite structure and an average particle diameter of 0.05 to 2.0 μm and comprise iron as the main component, are obtained in the following manner. An aqueous ferrous salt solution is allowed to react with an aqueous alkali hydroxide solution containing 0.80 to 0.99 equivalent of alkali hydroxide based on one equivalent of $Fe^{2+}$ in the aqueous ferrous salt solution, to give a suspension containing ferrous hydroxide colloids. The suspension is aerated with an oxygen-containing gas while being heated within a temperature range from 45 to 100° C. (to effect a magnetite forming reaction) so that the ferrous hydroxide colloids are oxidized to form magnetite particles, whereby a suspension containing the magnetite particles is produced. Then, an aqueous solution of Mn or Mn and $Fe^{2+}$ is added to the suspension containing the magnetite particles so that 8 to 150 atomic percent of Mn is contained relative to the total Fe in the solution. Thereafter, the suspension is heated and oxidized under the same conditions as those for the magnetite forming reaction to coat the surface of the magnetite particles with a hydroxide of Mn or hydroxides of Mn and Fe. Then, the magnetite particles coated with the hydroxide of Mn or the hydroxides of Mn and Fe are filtered, washed with water, dried, and calcined within a temperature range from 750 to 1000° C.

Conditions for producing the Mn-containing octahedral or spherical particles which have the hematite structure and comprise iron as the main component are detailed. As the aqueous ferrous salt solution, ferrous sulfate, ferrous chloride, or the like can be used. As the aqueous solution of an Mn compound, manganese sulfate, manganese chloride, or the like can be used. It is preferable to add the Mn compound in the form of an aqueous solution in order to coat the surface of the magnetite particles uniformly. As the aqueous alkali hydroxide solution, sodium hydroxide, potassium hydroxide, or the like, can be used.

Oxidation can be carried out by aerating the reaction suspension with the oxygen-containing gas (e.g., air), preferably using a reactor equipped with a stirrer. The magnetite particles coated with the hydroxide of Mn or the hydroxides of Mn and Fe are, then, heated within the temperature range from 750 to 1000° C. to obtain the Mn-containing particles having the hematite structure and comprising iron as the main component. If the temperature is lower than 750° C., the degree of blackness of the particles is not sufficient, and if the temperature is higher than 1000° C., the particles grow too large to obtain a desired coloring ability. Calcination is carried out in an ambient air to oxidize the magnetite and transform it into the form having a hematite structure.

The amount of the particles having the hematite structure to be added into the toner is within a range from 5 to 50% by weight, preferably 10 to 30% by weight. If the amount is less than 5% by weight, a sufficient degree of blackness cannot be obtained. If the amount is more than 50% by weight, strength of the toner is reduced. This is not preferable because the toner detaches from the toner image fixed by heat-pressing on the paper when it is folded or the like.

The electrophotographic black toner of the present invention comprises the toner particles containing at least a colorant and a binder resin. The toner contains, as the colorant, 20% by weight or less of a metal oxide whose magnetization is 40 emu/g or smaller. An image formed with the toner after fixation has color coordinates such that L* has a value of 10 to 25, a* has a value of 3.0 to 3.0 and b* has a value of −3.0 to 3.0.

Since the toner particles contain as the colorant 20% by weight or less of the metal oxide whose magnetization is 40 emu/g or smaller and satisfy the above specified color coordinates, the electrophotographic toner of the present invention has a high volume-specific resistance value, achieves a sufficient degree of blackness, is less likely to cause high background, and provides a high quality image. Particularly, since the magnetization of the colorant is as low as 40 emu/g or smaller, the toner can be preferably used in a two-component developer. Further, high background is less likely to occur even when the toner is used in combination with a carrier having a low resistance, whereby high quality images can be obtained.

The electrophotographic black toner of the present invention satisfies color coordinates such that L* has a value of 10 to 25, a* has a value of −3.0 to 3.0, and b* has a value of −3.0 to 3.0 after being fixed. Any values outside these ranges impair a sufficient degree of blackness. Further, considering a black hue, L* value is preferably 10 to 24, more preferably 15 to 23, a* value is preferably −2.5 to 2.0, more preferably −2.0 to 1.0, and b* value is preferably −2.5 to 2.0, more preferably −2.0 to 1.0.

The color coordinates described herein refer to the measured values of color specification indices L*, a* and b* obtained for solid images developed with respective toners using X-Rite938 (light source: $D_{50}$ (correlated color temperature 5000 K.), field of vision: 2 degrees). The a* value indicates a reddish hue. The larger the value, the darker the red given. The b* value indicates a yellowish hue. The larger the value, the darker the yellow given. The L* value indicates lightness. The solid image is obtained by copying an original which contains a solid black portion, or by printing an image datum which contains a solid black portion. Specifically, a fixed image, wherein the amount of toner forming a solid image on a transfer material (such as paper) is 1×d g/m$^2$ [wherein d represents a volume average diameter of the toner particles to be used], is measured for the above values.

The desired electrophotographic black toner in which the above-specified range of color coordinates are satisfied and a black hue is adjusted to obtain a sufficient degree of blackness can be realized by making the toner particles further contain as another colorant (such as a pigment) 20% by weight or less of a metal oxide whose magnetization is 40 emu/g or smaller, or otherwise additional metal atoms, as described later.

The followings are details about toner particles.

The toner particles contain at least a colorant and a binder resin. Specifically, the toner particles contain as the colorant 20% by weight or less of a metal oxide whose magnetization is 40 emu/g or smaller, as described above. The metal oxide content in the toner particles is preferably 17% by weight or less, more preferably 15% by weight or less. If the metal oxide content is less than 5% by weight, a preferred product may not be obtained, since a sufficient degree of blackness is not achieved. If the metal oxide content is more than 20% by weight, high background occurs.

Magnetization of the metal oxide is 40 emu/g or smaller, preferably 30 emu/g or smaller. If the magnetization is larger than 40 emu/g, magnetic property of the toner is reinforced, leading to a reduction in toner development and hence high background and the like occur. The magnetization used herein refers to the value measured when an external magnetic field is 10kOe.

A volume-specific resistance value of the metal oxide is preferably $10^5$ Ω·cm or higher (when a voltage of 100V/cm is applied), more preferably $10^6$ Ω·cm or higher (when a voltage of 100V/cm is applied). If the volume-specific resistance value is lower than $10^5$ Ω·cm, high background may occasionally occur.

The volume-specific resistance value is measured as follows. A sample is placed on a lower electrode of a measuring device, which is a pair of disk-type electrodes of 20cm$^2$ (made of steel) connected to an electrometer (KEITHLEY 610C manufactured by Keithley) and to a high voltage power supply (FLUKE415B manufactured by Fluke), so as to form a flat layer having a thickness of 1 to 3 mm. Then, an upper electrode is put on the sample, and a 4 Kg weight is applied on the upper electrode to eliminate the space above the sample. A thickness of the sample layer is measured in this state. Then, a current value is measured by applying a voltage to both of the electrodes, and a volume-specific resistance is calculated according to the following equation:

$$\text{Volume-Specific Resistance} = \text{Applied Voltage} \times 20 \div (\text{Current Value} - \text{Initial Current Value}) \div \text{Sample Thickness}$$

[wherein the initial current value is a value measured when the applied voltage is 0, and the current value is a measured current value].

The metal oxide is preferably in the form of particles from a viewpoint of dispersibility in the toner. An average particle diameter of the particles is preferably 0.02 to 2 μm, more preferably 0.02 to 0.5 μm. If the average particle diameter is smaller than 0.02 μm, dispersion of the particles is difficult due to their minuteness. If the average particle diameter is over 2 μm, the particle diameter is too large to obtain a sufficient degree of blackness. The particles may be that of an isotropic particulate powder having a sphericity (a ratio of the average diameter of the longest portion to the average diameter of the shortest portion) of less than 2, such as spherical, octahedral, hexahedral, granular particles, or the like, or that of an anisotropic particulate powder having an axis ratio (a ratio of the average major axis diameter to the average minor axis diameter) of 2 or more, such as acicular, spindle-shaped, rice granular particles, or the like.

Examples of the metal oxides include iron oxide, ferrite, titanium black, and the like. Among them, ferrite is preferable since it has a good volume-specific resistance value. Examples of the ferrite include known ferrites such as magnetite, manganese-zinc type ferrite, nickel-zinc type ferrite, manganese-magnesium type ferrite, copper-zinc type ferrite, and the like. Among them, magnetite is preferable from a viewpoint of ease of controlling magnetic force. Both of the magnetite having a spinel structure and the magnetite having a hematite structure can be used, however, the magnetite having the hematite structure is preferable from a viewpoint of obtaining a desired black hue as the colorant (toner) described later.

The metal oxide may further include additional metal atoms as long as the atoms satisfy the above-specified range of magnetization, from a viewpoint of obtaining a sufficient degree of blackness by adjusting the black hue. Examples of additional metal atoms include Ti, Cu, Zn, and the like, and Ti is preferably included in view of safety. The amount of additional metal atoms to be included in the metal oxide is suitably selected depending on a black hue, and is preferably 5 to 40% by weight. A specific example of the metal oxide containing additional metal atoms is magnetite particles containing, for example, Ti, and such magnetite particles exhibit a more preferable black hue.

Examples of methods to produce the magnetite particles containing Ti are described below, but are not limited thereto.

Octahedral magnetite particles having an average particle diameter of 0.05 to 2.0 $\mu$m and containing Ti are obtained in the following manner. An aqueous ferrous salt solution is allowed to react with an aqueous alkali hydroxide solution containing 1.01 to 1.3 equivalent of alkali hydroxide based on one equivalent of $Fe^{2+}$ in the aqueous ferrous salt solution, to give a suspension containing ferrous hydroxide colloids. The suspension is aerated with an oxygen-containing gas while being heated within a temperature range from 45 to 100° C. (to effect a magnetite forming reaction) so that the ferrous hydroxide colloids are oxidized to form magnetite particles, whereby a suspension containing the magnetite particles is produced. Then, an aqueous solution of Ti or Ti and $Fe^{2+}$ is added to the suspension containing the magnetite particles so that 8 to 150 atomic percent of Ti is contained relative to the total Fe in the solution. Thereafter, the suspension is heated and oxidized under the same conditions as those for the magnetite forming reaction to coat the surface of the magnetite particles with a hydroxide of Ti or hydroxides of Ti and Fe. Then, the magnetite particles coated with the hydroxide of Ti or the hydroxides of Ti and Fe are filtered, washed with water, dried, and calcined within a temperature range from 600 to 1000° C.

Spherical magnetite particles having an average particle diameter of 0.05 to 2.0 $\mu$m and containing Ti are obtained in the following manner. An aqueous ferrous salt solution is allowed to react with an aqueous alkali hydroxide solution containing 0.80 to 0.99 equivalent of alkali hydroxide based on one equivalent of $Fe^{2+}$ in the aqueous ferrous salt solution, to give a suspension containing ferrous hydroxide colloids. The suspension is aerated with an oxygen-containing gas with heating at a temperature range from 45 to 100° C. (to effect a magnetite forming reaction) so that the ferrous hydroxide colloids are oxidized to form magnetite particles, whereby a suspension containing the magnetite particles is produced. Then, an aqueous solution of Ti or Ti and $Fe^{2+}$ is added to the suspension containing the magnetite particles so that 8 to 150 atomic percent of Ti is contained relative to the total Fe in the solution. Thereafter, the suspension is heated and oxidized under the same conditions as those for the magnetite forming reaction to coat the surface of the magnetite particles with a hydroxide of Ti or hydroxides of Ti and Fe. Then, the magnetite particles coated with the hydroxide of Ti or the hydroxides of Ti and Fe are filtered, washed with water, dried, and calcined within a temperature range from 600 to 1000° C.

In the production of the magnetite particles containing Ti, ferrous sulfate, ferrous chloride, or the like can be used as the aqueous ferrous salt solution. As the aqueous alkali hydroxide solution, sodium hydroxide, potassium hydroxide, or the like, can be used. Oxidization can be carried out by aerating the reaction suspension with the oxygen-containing gas (e.g., air), preferably using a reactor equipped with a stirrer.

It is preferred that the toner particles contain, besides the above-described metal oxides, a pigment which has a maximum peak of spectral reflectance in a range that excludes 600 nm to 700 nm as measured in a wavelength range from 400 nm to 700 nm (hereinafter, referred to simply as "pigment"), as the colorant. By using the metal oxide and the pigment in combination as the colorant, the black hue can be adjusted to obtain a more preferable blackness. The following is a specific case in which the metal oxide is the magnetite particles (hematite structure). The magnetite particles (hematite structure) themselves have a hue ranging from reddish brown to dark brown. If this is explained in terms of spectral reflectance of the particles, it means that the reflectance in the wavelength region above 500 nm is higher than the reflectance in the wavelength region below 500 nm. This is a physical property originating from its structure. As described above, by doping additional metal atoms (such as Ti, Cu, Zn, or the like) to the magnetite particles, the black hue is preferably improved. Further, by making the above-described pigment coexistent with the magnetite particles (hematite structure) in the toner, the toner acquires a sufficient degree of blackness since the hue, ranging from reddish brown to dark brown when the magnetite particles are used singly, can be adjusted.

A weight ratio of said particles having a hematite structure to the pigment that has a maximum peak of spectral reflectance in a range that excludes 600 to 700 nm is preferably 15:1 to 50:1. A spectral reflectance of the pigment can be measured in the following manner. 0.5 g of a sample and 0.7 cc of castor oil are mixed and kneaded into a paste using a Hoover muller. Then, 4.5 g of clear lacquer is added to the paste, and the paste is kneaded to form a paint. Then, the paint is applied on cast-coated paper using a 6 mil applicator to prepare a piece of coated paper (coating thickness is about 30 gm), and the piece of coated paper is measured for spectral reflectance using X-Rite938 (light source: $D_{50}$, field of vision: 2 degrees).

It is preferred that the pigment has a volume-specific resistance value of $10^5$ Ω·cm or higher (when a voltage of 100V/cm is applied), more preferably $10^6$ Ω·cm or higher (when a voltage of 100V/cm is applied), from a viewpoint of suppressing charge leakage. The volume-specific resistance value is measured in the same manner as described above.

As the pigment, any known pigment can be used which has a maximum peak of spectral reflectance in the range that excludes 600 nm to 700 nm, as measured in a range from 400 nm to 700 nm. That is, the pigment has a maximum peak of spectral reflectance in the region of 400 to 500 nm and has a lower spectral reflectance in the region of 600 to 700 nm. Specific examples of the particles include, but are not limited to, aniline blue, ultramarine blue, phthalocyanine blue, malachite green oxalate, C.I.Pigment Blue15:1, Pigment Blue 15:3, and the like. Further, C.I.Pigment Blue15: Fastogen Blue GS (produced by Dainippon Ink and Chemicals, Inc.), Chromobine SR (produced by Nippon Seisha), C.I.Pigment Blue16: Sumitone Cyanine Blue LG (produced by Sumitomo Chemical Company Ltd.), C.I.Pigment Green7: Phthalocyanine Green (Produced by Toyo Ink Manufacturing Co., Ltd.), C.I.Pigment Green36: Cyanine Green 2YL (Produced by Toyo Ink Manufacturing Co., Ltd.), C.I.Pigment Blue15:13: Cyanine GGK (produced by Nippon Pigment Co., Ltd.), C.I.Pigment Blue15:3: Lionol Blue FG-7351 (Produced by Toyo Ink Manufacturing Co., Ltd.), and the like.

The amount of the pigment to be included in the toner particles is preferably 0.1 to 2.0% by weight, more preferably 0.1 to 1.0% by weight. If the amount is less than 0.1% by weight, a hue may not be adjusted sufficiently. While, if the amount is more than 2.0% by weight, an undesirable result may be produced in which a hue exhibited by the pigment itself, not by the toner, tends to appear.

Other known colorants may be used in combination with the above-described metal oxide and pigment in the toner particles, as long as the colorant satisfies the above-specified color coordinates.

Examples of the binder resins include homopolymers and copolymers of styrenes such as styrene, chlorostyrene, and the like; monoolefins such as ethylene, propylene, butylene, isoprene, and the like; vinyl esters such as vinyl acetate, vinyl propionate, vinyl benzoate, and the like; α-methylene aliphatic monocarboxylates such as methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate, and the like; vinyl ethers such as vinyl methyl ether, vinyl ethyl ether, vinyl butyl ether, and the like; vinyl ketones such as vinyl methyl ketone, vinyl hexyl ketone, vinyl isopropenyl ketone, and the like. Particularly typical binder resins include polystyrene, styrene/alkyl acrylate copolymer, styrene/alkyl methacrylate copolymer, styrene/acrylonitrile copolymer, styrene/butadiene copolymer, styrene/maleic anhydride copolymer, polyethylene, polypropylene, and the like. Further, polyester resin, polyurethane resin, epoxy resin, silicone resin, polyamide resin, modified rosin, paraffin, waxes, and the like, can be included. Among them, polyester resin is particularly preferably used as the binder resin.

The polyester resin is synthesized by, for example, polycondensation of a polyol component and a polycarboxylic acid component. Particularly, a linear polyester resin, composed of a polycondensate comprising as the main monomer components bisphenol A and polyvalent aromatic carboxylic acid, can be preferably used. Examples of the polyol components include ethylene glycol, propylene glycol, 1,3-butanediol, 1,4-butanediol, 2,3-butanediol, diethylene glycol, triethylene glycol, 1,5-butanediol, 1,6-hexanediol, neopentyl glycol, cyclohexane dimethanol, hydrogenated bisphenol A, adduct of bisphenol-A and ethylene oxide, adduct of bisphenol-A and propylene oxide, and the like. Examples of the polycarboxylic acid components include maleic acid, fumaric acid, phthalic acid, isophthalic acid, terephthalic acid, succinic acid, dodecenyl succinic acid, trimellitic acid, pyromellitic acid, cyclohexane tricarboxylic acid, 2,5,7-naphthalene tricarboxylic acid, 1,2,4-naphthalene tricarboxylic acid, 1,2,5-hexane tricarboxylic acid, 1,3-dicarboxyl-2-methylene carboxypropane tetramethylene carboxylic acid, and anhydrides thereof.

As the binder resin, a resin having a softening point of 90 to 150° C., a glass transition point of 50 to 75° C., a number average molecular weight of 2000 to 6000, a weight average molecular weight of 8000 to 150000, 0 to 30% by weight of a THF-insoluble gel component, an acid value of 0 to 30, a hydroxyl value of 0 to 40 can be particularly preferably used.

Besides the colorant and the binder resin, the toner particles may contain internal additives such as a known wax for providing a good fixation, a known charge controlling agent for adjusting the charge level, a known petroleum resin for providing the toner with grindability and heat retainment, and the like.

Examples of the waxes include paraffin wax and derivatives thereof, montan wax and derivatives thereof, microcrystalline wax and derivatives thereof, Fischer-Tropsch wax and derivatives thereof, polyolefin wax and derivatives thereof, and the like. The derivatives include an oxide, a polymer with a vinyl monomer and a graft modified product. Further, alcohol, fatty acid, vegetable wax, animal wax, mineral wax, ester wax, acid amide, and the like can be used.

As the charge controlling agent, known agents can be used, and examples thereof include an azo-type metal complex compound, a metal complex compound of salicylic acid, a resin-type charge controlling agent containing a polar group, and the like. When toner particles are produced in a wet-type production method, it is preferable to use a material which is low in solubility in water in order to control ionic strength and to reduce pollution caused by waste water.

Examples of the petroleum resins include products synthesized from diolefin and monoolefin which are formed as the by-product in an ethylene plant producing ethylene, propylene, or the like, by steam cracking of petroleum and contained in decomposed oil fractions.

A production method of the toner particles is not particularly limited, and the toner particles can be produced by conventionally known methods. For example, a known kneading method in which a predetermined amount of the binder resin and a predetermined amount of the colorant are mixed, kneaded, and milled can be used. Specifically, a mixture of the colorant and the binder resin, which may further contain a surface lubricant, a charge controlling agent, and other additives as necessary, is sufficiently mixed using a mixer. Then, the resin and the like are melted and kneaded using a heat kneader to render the components compatible with one another, and subsequently cooled and hardened to obtain a kneaded resin product. The kneaded resin product is milled and classified to obtain black toner particles having a desired particle size. As the mixer, a Henschel mixer, a ball mill, or the like, can be used. Kneading can be carried out using any of various heat kneaders such as three-roll type, single screw type, double screw type, Banbury mixer type, and the like. Milling of the kneaded product is carried out using, for example, Micronizer, Ulmax, Jet-o-mizer, KTM (Krypton), Turbomill, I-type Jet-Mill, or the like. Classification is carried out using pneumatic type Elbowjet utilizing Coander effect, or the like. Further, in a succeeding step, a particle shape can be changed, by applying hot air using Hybridization System (manufactured by Nara Kikai Seisakusho), Mechanofusion System (manufacture by Hosokawa Micron Corporation), Krypton System (manufactured by Kawasaki Heavy Industries, Ltd.), or the like. The shape of the particle can be changed by the hot air to even a spherical shape.

The toner particles can also be produced by suspension polymerization or emulsion polymerization. In the suspension polymerization, the monomer composition made from a mixture of the colorant and the binder resin, in which a polymerization initiator, a linking agent, a charge controlling agent, and other additives as necessary are dissolved or dispersed, is added to a liquid phase containing a suspension stabilizer with stirring, granulated, and polymerized to form black toner particles having a desired particle size. In the emulsion polymerization, a mixture of the colorant and the binder resin is subjected to polymerization by dispersing a polymerization initiator and the like in water as necessary and adding an emulsifier during a polymerization process to form black toner particles having a desired particle size.

The electrophotographic toner of the present invention may contain external additives outside the toner particles, that is, the toner particles may be surface modified by adding the external additives. For example, as the external additives, inorganic powder, resin powder, and the like, are added singly or in combination thereof to the surfaces of the toner particles for improving long-term preservability, fluidity, developing property, and transferring property of the toner. Examples of the inorganic powders include carbon black, silica, alumina, titania, zinc oxide, and the like. Examples of the resin powders include spherical particles such as PMMA, nylon, melamine, benzoguanamine, fluorine-type, and the like, and the powders having an irregular shape such as vinylidene chloride, metal salts of fatty acid, and the like. The amount of the external additives to be added is preferably 0.1 to 4% by weight, more preferably 0.3 to 3% by weight.

In the electrophotographic toner of the present invention, the toner particles and the external additives can be mixed by a known method. Specifically, the toner particles and the external additives can be sufficiently mixed using a mixer. As the mixer, Henschel mixer, ball mill, or the like can be used.

Electrophotographic Developer

An electrophotographic developer of the present invention contains the electrophotographic black toner of the present invention described above and a carrier. As stated above, by using the electrophotographic black toner of the present invention, the electrophotographic developer of the present invention has a sufficient degree of blackness and is unlikely to cause high background, thereby providing a high quality image.

The carrier may be any known carrier, and examples thereof include, but are not particularly limited to, an iron powder type carrier, a ferrite type carrier, a surface coated ferrite carrier, and the like. Further, examples preferably include a surface coated carrier and the like.

When the carrier is contained in the electrophotographic developer, an electric resistance of the developer is preferably within a range from $6.2\times10^4$ to $1.0\times10^{15}$ Ω, more preferably from $6.2\times10^4$ to $1.0\times10^{10}$ Ω·under an electrical field intensity of 2.0V/μm. The electric resistance of the electrophotographic developer is measured as follows: first, a magnetic brush developer layer composed of 6 parts of toner to 100 parts of carrier is formed; then, a resistance (electric resistance value) of the magnetic brush developer layer per unit length in a longitudinal direction of a sleeve (a developer holding member) at a toner density which is suitable for obtaining an appropriate development weight [37×d/D (weight %), wherein d represents a volume average particle diameter (μm) of the toner particles, and D represents a volume average particle diameter (μm) of the carrier] is measured. By controlling the electric resistance value of the developer as described above, a good reproducibility of a solid image can be obtained, and formation of blank portions and brush marks in the regions from low density to high density can be prevented. If the electric resistance value of the developer is higher than $1.0\times10^{15}$ Ω, formation of blank portions at a rear fringe of a halftone area at a boundary between the halftone area and a solid image area is notable. While, if the electric resistance value of the developer is lower than $6.2\times10^4$ Ω, brush marks may be formed occasionally. Even when a carrier has a low electric resistance, the combined use of the carrier and the electrophotographic toner of the present invention inhibits high background and achieves a high quality image. The electric resistance value of the carrier is an electric resistance in an actual developer nip, which is obtained as follows: forming a magnetic brush layer on a development sleeve; placing a photosensitive material and an aluminum pipe of the same size as the photosensitive material to face each other in the same way as an actual developer nip is disposed; applying a direct voltage between the sleeve and the aluminum pipe; determining a resistance value from the flowing current; and dividing the resistance value by a length (cm) of a portion of the sleeve which is covered by the developer. The developer preferably contains 1 to 20 parts of toner to 100 parts of-carrier.

Image Forming Method

An image forming method of the present invention comprises: a charging step for charging the surface of a latent image holding member uniformly; an exposing step to form an electrostatic latent image on the latent image holding member; a developing step for developing the electrostatic latent image with a developer on a developer holding member to form a toner image; a transferring step for transferring the toner image onto a transfer member; and a fixing step for fixing the toner image to the transfer member; and as at least one of various types of the toner, the electrophotographic black toner described in <1> above is used. As described above, by using the electrophotographic black toner of the present invention, the image forming method of the present invention produces a sufficient degree of blackness and inhibits the occurrence of high background, thereby providing a high quality image. Further, the image forming method of the present invention may include any other known steps.

As the latent image holding member acting in a photosensitive layer, known latent image holding members such as organic type, amorphous silicon, or the like, can be used. The electrostatic latent image holding member having a cylindrical shape can be made by a known production method such as extruding aluminum, an aluminum alloy, SUS, or the like, and conducting surface treatment. From the viewpoint of the recent trend of miniaturization of the devices, it is preferable to use a latent image holding member having a small diameter of 50 mm or less. A belt-type electrostatic latent image holding member can also be used.

In the charging step, conventionally known methods such as non-contact charging using a colotron, or the like, and contact-charging using a charging roll, a charging film, a charging brush, or the like, are applicable. Considering an amount of ozone to be generated, a contact-type charging device is preferably used.

In the exposing step, conventionally known methods are applicable, wherein a latent image is formed on the latent image holding member such as a photosensitive layer, a dielectric layer, or the like, by electrophotography or electrostatic recording.

In the developing step, the developer layer composed of the developer containing the toner formed on the surface of the developer holding member is conveyed to a developer nip, the developer layer and the electrostatic latent image holding member are brought into contact or positioned with a predetermined spacing at a developing section, and the electrostatic latent image is developed with the toner while a bias is applied between the developer holding member and the latent image holding member. As the developer, a two-component developer is used in which a toner is charged using a carrier, or alternatively a one-component developer is used in which a thin layer of a toner is formed on a developer holding member using an elastic blade to ensure adequate toner charge.

In the transferring step, a contact-type transferring method in which the toner image is transferred onto the transfer member by bringing a transfer roller, a transfer belt, or the like, in press-contact with the electrostatic latent image holding member, or a non-contact type method in which the toner image is transferred onto the transfer member using a colotron or the like can be used.

In the fixing step, the toner image transferred onto the transfer member is fixed using a fixing device. For fixing, a thermal fixing method using a heat roll or belt is preferably used.

EXAMPLES

Hereinafter, the present invention is described in more detail with reference to examples. However, these examples are not intended to limit the present invention. In the following examples, "parts" means "parts by weight". Values in the examples have been measured according to the methods described above.

[I] Production of Hematite Particles

Black Powder A (hematite particles containing Mn)

To 200 liters of water and 60 liters of a 15.5N aqueous sodium hydroxide solution, which had been prepared beforehand in a reactor equipped with a stirrer, was added 300 liters of an aqueous ferrous sulfate solution having a concentration of 1.30 mol/l, to produce an aqueous ferrous salt solution containing ferrous hydroxide at a temperature of 85° C. and a pH value of 13 or higher.

The aqueous ferrous salt solution containing ferrous hydroxide was aerated with air at a rate of 270 1/minute at a temperature of 90° C. for 90 minutes to thereby form magnetite particles. Then, to 500 liters of a suspension containing 29.6 kg of the magnetite particles in water were added 100 liters of an aqueous ferrous sulfate solution having a concentration of 1.3 mol/l, 100 liters of an aqueous manganese sulfate solution having a concentration of 1.3 mol/l (corresponding to 20 atomic percent of Mn relative to the amounts of Fe and Mn) and 46 liters of a 11.2N aqueous sodium hydroxide (corresponding to an amount capable of neutralizing the amounts of Mn and $Fe^{2}$+added). The resultant mixture was aerated with air at a rate of 700 1/minute, a pH value of 13 or higher, and a temperature of 90° C., for 180 minutes to form magnetite particles coated with hydroxides of Mn and Fe. The generated particles were filtered, washed with water, dried and milled as in an ordinary method to produce a black powder. Subsequently, the produced black powder was passed through a continuous electric furnace having a ceramic central tube, and dwelled for 60 minutes on an average in air at 900° C. to obtain a black powder A.

The thus obtained black powder A had an average particle diameter of 0.25 μm, contained 14.8% by weight of Mn (measured through X-ray fluorescence analysis), and had a peak characteristic of hematite (confirmed by X-ray diffraction). As to magnetic properties, a magnetization value was 0.8 emu/g when an external magnetic field of 10kOe was applied. A volume-specific resistance value of the particles was $3.8\times10^{6}$ Ω·cm.

| <Toner 1> | |
|---|---|
| Linear polyester (a linear polyester produced from terephthalic acid/adduct of bisphenol A and ethylene oxide/cyclohexane dimethanol: Tg = 62° C., Mn = 4,000, Mw = 35,000, acid value = 12, hydroxy value = 25) | 79.5 parts |
| Black powder A | 15 parts |
| C.I. Pigment Blue 15:3 (Lionol Blue FG-7351, produced by Toyo Ink Manufacturing Co., Ltd., maximum peak wavelength: 460 nm) | 0.5 parts |
| Purified granular carnauba wax (manufactured by Toa Kasei Co., Ltd.) | 5 parts |

The above mixture was kneaded with an extruder and milled with a surface-grinding-type mill, and classified into fine particles and coarse particles with a pneumatic classifier to obtain black toner particles having $d_{50}$=9.1 μm. A volume-specific resistance value of the particles was $4.6\times10^{14}$ Ω·cm.

Toner 2

Black toner particles having $d_{50}$=6.5 μm were obtained in the same manner as that for the toner 1 except that C.I.Pigment Blue 15:3 was replaced with C.I.Pigment Blue 15 (Fastogen Blue GS produced by Dainippon Ink and Chemicals, Inc., maximum peak wavelength: 460 nm). A volume-specific resistance value of the particles was $3.6\times10^{14}$ Ω·cm.

| <Toner 3> | |
|---|---|
| Linear polyester (a linear polyester produced from terephthalic acid/adduct of bisphenol A and ethylene oxide/adduct of bisphenol A and propylene oxide/ cyclohexane dimethanol: Tg = 70° C., Mn = 4,600, Mw = 38,000, acid value = 11, hydroxy value = 23) | 89.5 parts |
| Black powder A | 10 parts |
| C.I. Pigment Blue 15:3 (Lionol Blue FG-7351, produced by Toyo Ink Manufacturing Co., Ltd., maximum peak wavelength: 460 nm) | 0.3 parts |

The above mixture was prepared beforehand, then kneaded with an extruder, milled with a jet mill, and classified with a pneumatic classifier to obtain black toner particles having an average particle diameter of 7.8 μm. A volume-specific resistance value of the particles was $1.8\times10^{15}$ Ω·cm.

Toner 4

Black toner particles having $d_{50}$=6.1 μm were obtained in the same manner as that for the toner 3 except that the amount of the black powder A was changed from 10 parts to 20 parts, and the amount of the linear polyester was changed from 89.5 parts to 79.5 parts. A volume-specific resistance value of the particles was $1.6\times10^{14}$ Ω·cm.

Toner 5

Black toner particles having $d_{50}$=7.2 μm were obtained in the same manner as that for toner 1 except that the C.I.Pigment Blue 15:3 was not added. A volume-specific resistance value of the particles was $5.6\times10^{14}$ Ω·cm.

| <Toner 6 > | |
|---|---|
| Linear polyester (a linear polyester produced from terephthalic acid/adduct of bisphenol A and ethylene oxide/adduct of bisphenol A and propylene oxide/cyclohexane dimethanol: Tg = 70° C., Mn = 4,600, Mw = 38,000, acid value = 11, hydroxy value = 23) | 83 parts |
| Carbon black (BPL produced by Cabot) | 10 parts |
| Low molecular weight polyethylene | 7 parts |

The above mixture was prepared in advance, then kneaded with an extruder, milled with a jet mill, and classified with a pneumatic classifier to obtain black toner particles having an average particle diameter of 8.8 μm. A volume-specific resistance value of the particles was $3.6\times 10^{14}$ Ω·cm. Then, to 100 parts of the resulting toner were added 1.0 parts of negatively charged silica and 0.6 parts of negatively charged titania to produce the toners 1 to 6 in which the external additives were added outside the toner.

Carrier A

Into a vacuum deaeration-type kneader were fed 100 parts by weight of ferrite particles which had an average particle diameter of 35 μm (measured using Microtruck) and exhibited a saturation magnetization of 70 emu/g, a residual magnetization of 2 emu/g and a coercive force of 12 oersteds, respectively, as measured at 3000 oersteds, 0.5 parts by weight of styrene/methyl methacrylate copolymer, and 14 parts by weight of toluene and stirred for 30 minutes at a temperature of 90° C. Subsequently toluene was evaporated off under reduced pressure and then a coating layer was formed thereon to obtain a carrier A.

Carrier B

Into a vacuum deaeration-type kneader were fed 100 parts by weight of ferrite particles which had an average particle diameter of 35 μm (measured using Microtruck) and exhibited a saturation magnetization of 70 emu/g, a residual magnetization of 2 emu/g and a coercive force of 12 oersteds, respectively, as measured at 3000 oersteds, 1.2 parts by weight of styrene/methyl methacrylate copolymer, and 14 parts by weight of toluene and stirred for 30 minutes at a temperature of 90° C. Subsequently toluene was evaporated off under reduced pressure and then a coating layer was formed thereon to obtain a carrier B.

Examples 1 to 8, Comparative Examples 1 to 4

The toners 1 to 6 and the carriers A and B obtained above were used and tested as shown in Table 1. Specifically, 6 parts of the respective toners in which external additives were included were added to 100 parts of the respective carriers and mixed to obtain the developers for use in Examples 1 to 8 and Comparative Examples 1 to 4.

The obtained developers were evaluated for the parameters shown in Table 1. A 1000-sheet copying test for each developer was performed under the conditions of humidity of 85% and temperature of 28° C. using a commercially available copier (A-Color630 manufactured by Fuji Xerox Co., Ltd.). Then, respective developers were sampled and measured for the amount of charge. The copier was left unused overnight. The following day, respective developers were sampled and measured for the amount of charge again. The first copy was examined to determine if high background occurred. Further, a 30000-sheet copying test for each developer was performed, and then respective developers were sampled and evaluated for the amount of charge. The copier was left unused overnight. The following day, respective developers were sampled and evaluated for the amount of charge again. The first copy was examined to determine if high background occurred. The amounts of charge were measured using TB200 (manufactured by Toshiba). The occurrence of high background was examined visually. The developers were measured for electric resistance in the manner described above.

Color Coordinates

After a 1000-sheet copying test was performed under the conditions of humidity of 85% and temperature of 28° C. using a commercially available copier (A-Color630 manufactured by Fuji Xerox Co., Ltd.), the solid image obtained by adjusting a development bias so that the amount of toner forming the solid image on a transfer member (such as paper) would be 1×d g/m$^2$[wherein d represents a volume average particle diameter (μm) of the toner particles to be used] was measured for color ordinates as described above.

TABLE 1

| | | | | | | | After 1000-sheet Test | | | After 30000-sheet Test | | |
|---|---|---|---|---|---|---|---|---|---|---|---|---|
| | Toner | Carrier | Initial Electric Resistance (Ω) | Color Coordinates L* | a* | b* | Amount of Charge (μC/g) | Amount of Charge After Being Left Overnight (μC/g) | High Back-ground | Amount Of Charge (μC/g) | Amount Of Charge After Being Left Overnight (μC/g) | High Back-ground |
| Ex. 1 | Toner 1 | A | $1.5\times 10^{5}$ | 16.5 | 1.5 | 1.7 | −22.3 | −19.9 | Not Observed | −18.5 | −17.5 | Not Observed |
| Ex. 2 | Toner 2 | A | $5.0\times 10^{9}$ | 17.0 | 1.1 | 1.3 | −31.8 | −29.5 | Not Observed | −25.1 | −22.8 | Not Observed |
| Ex. 3 | Toner 3 | A | $2.5\times 10^{7}$ | 17.2 | 3.0 | 2.3 | −27.6 | −26.1 | Not Observed | −23.0 | −21.5 | Not Observed |
| Ex. 4 | Toner 4 | A | $7.5\times 10^{10}$ | 18.3 | 2.9 | 2.4 | −33.5 | −30.5 | Not Observed | −25.9 | −23.5 | Not Observed |

TABLE 1-continued

| | | | | | | | After 1000-sheet Test | | | After 30000-sheet Test | | |
|---|---|---|---|---|---|---|---|---|---|---|---|---|
| | Toner | Carrier | Initial Electric Resistance (Ω) | Color Coordinates L* | a* | b* | Amount of Charge (μC/g) | Amount of Charge After Being Left Overnight (μC/g) | High Back-ground | Amount Of Charge (μC/g) | Amount Of Charge After Being Left Overnight (μC/g) | High Back-ground |
| Ex. 5 | Toner 1 | B | $1.5 \times 10^8$ | 16.4 | 1.6 | 1.8 | −25.9 | −23.8 | Not Observed | −23.8 | −22.1 | Not Observed |
| Ex. 6 | Toner 2 | B | $7.5 \times 10^{13}$ | 16.8 | 1.2 | 1.4 | −35.1 | −33.1 | Not Observed | −32.5 | −32.2 | Not Observed |
| Ex. 7 | Toner 3 | B | $1.3 \times 10^9$ | 17.5 | 2.8 | 2.0 | −27.8 | −26.2 | Not Observed | −25.8 | −22.9 | Not Observed |
| Ex. 8 | Toner 4 | B | $6.0 \times 10^{14}$ | 13.4 | 2.9 | 2.2 | −35.1 | −35.0 | Not Observed | −33.5 | −32.2 | Not Observed |
| Com. Ex. 1 | Toner 5 | A | $1.5 \times 10^8$ | 11.9 | 5.3 | 4.7 | −26.8 | −26.5 | Not Observed | −24.2 | −23.4 | Not Observed |
| Com. Ex. 2 | Toner 6 | A | $6.0 \times 10^6$ | 12.8 | 1.0 | 1.2 | −23.6 | −20.1 | Not Observed | −19.6 | −15.0 | Observed |
| Com. Ex. 3 | Toner 5 | B | $3.5 \times 10^9$ | 11.3 | 4.8 | 4.5 | −27.8 | −27.3 | Not Observed | −23.9 | −23.1 | Not Observed |
| Com. Ex. 4 | Toner 6 | B | $1.5 \times 10^8$ | 12.0 | 1.0 | 1.1 | −25.0 | −22.0 | Not Observed | −20.1 | −16.2 | Observed |

For each of the obtained developers (containing each of the toners 1 to 6), a 1000-sheet copying test was performed under the conditions of humidity of 85% and temperature of 28° C. using a commercially available copier (A-Color630 manufactured by Fuji Xerox Co., Ltd.). Then, spectral reflectance of a solid image in the 1000th copy was measured (see FIG. 1). Further, density of the solid image was measured for each toner using X-Rite938 (light source:$D_{50}$, field of vision: 2 degrees).

In these Examples and Comparative Examples, as can be seen from spectral reflectance of the solid portions in the fixed image, the toners 1 to 4 exhibited similar reflectance in a wavelength range of 400 to 700 nm and these toners had a satisfactory black hue, and reproducibility of the solid portion and a halftone portion was good in the long-term copying test. Further, the toners 1 to 4 retained stable amounts of charge. On the other hand, spectral reflectance of the toner 5 apparently increased in the wavelength region above 550 nm, and the toner 5 exhibited a dark brown hue, thus failing to have a desired hue. The toner 6 had a satisfactory black hue, however, the amount of charge was largely decreased when the toner 6 had been left overnight after the 30000-sheet copying test using the copier, and high background was observed to occur in the copy.

[II] Production of Magnetite Particles

Black Powder A' (magnetite particles containing Ti

Black powder A' was produced which had an average particle diameter of 0.25 μm, contained 12.5% by weight of Ti (measured through X-ray fluorescence analysis), had a magnetization value of 14.4 emu/g when an external magnetic field of 10kOe was applied, and had a volume-specific resistance value of $1.8\times10^8$ Ω·cm.

Black Powder B' (magnetite particles containing Ti)

Black powder B' was produced which had an average particle diameter of 0.25 μm, contained 14.3% by weight of Ti (measured through X-ray fluorescence analysis), had a magnetization value of 25.4 emu/g when an external magnetic field of 10kOe was applied, and had a volume-specific resistance value of $2.8\times10^8$ Ω·cm.

Black Powder C' (magnetite particles)

Black powder C' was produced which had an average particle diameter of 0.2 μm, had a magnetization value of 84 emu/g when an external magnetic field of 10kOe was applied, and had a volume-specific resistance value of $5.8\times10^7$ Ω·cm.

| <Toner Particles 1'> Composition | |
|---|---|
| Linear polyester (a linear polyester produced from terephthalic acid/adduct of bisphenol A and ethylene oxide/cyclohexane dimethanol: Tg = 62° C., Mn = 4,000, Mw = 35,000, acid value = 12, hydroxy value = 25) | 79.5 parts |
| Black powder A' | 15 parts |
| C.I. Pigment Blue 15:3 (Lionol Blue FG-7351, produced by Toyo Ink Manufacturing Co., Ltd., a maximum peak of spectral reflectance occurred at 460 nm) | 0.5 parts |
| Purified granular carnauba wax (produced by Toa Kasei Co., Ltd.) | 5 parts |

A mixture of the above composition was kneaded with an extruder and milled with a surface-grinding-type mill, and classified into fine particles and coarse particles with a pneumatic classifier to obtain black toner particles 1' having $d_{50}$=9.5 μm. A volume-specific resistance value of the particles was $6.6\times10^{14}$ Ω·cm.

Toner Particles 2'

Black toner particles 2' having $d_{50}$=6.1 μm were obtained in the same manner as that for the toner particles 1' except that C.I.Pigment Blue 15:3 was replaced with C.I.Pigment Blue 1 (Fastogen Blue GS produced by Dainippon Ink and Chemicals, Inc., a maximum peak of spectral reflectance occurred at 460 nm). A volume-specific resistance value of the particles was $5.8\times10^{14}$ Ω·cm.

| <Toner Particles 3'> Composition | |
|---|---|
| Linear polyester (a linear polyester produced from terephthalic acid/adduct of bisphenol A and ethylene oxide/adduct of bisphenol A and propylene oxide/cyclohexane dimethanol: Tg = 70° C., Mn = 4 ,600, Mw = 38,000, acid value = 11, hydroxy value = 23) | 89.5 parts |
| Black powder B' | 10 parts |
| C.I. Pigment Blue 15:3 (Lionol Blue FG-7351, produced by Toyo Ink Manufacturing Co., Ltd., a maximum peak of spectral reflectance occurred at 460 nm) | 0.3 parts |

A mixture of the above composition was prepared in advance, then kneaded with an extruder, milled with a jet mill, and classified with a pneumatic classifier to obtain black toner particles 3' having $d_{50}$=8.1 μm. A volume-specific resistance value of the particles was $2.3\times10^{15}$ Ω·cm.

Toner Particles 4'

Black toner particles 4' having $d_{50}$=5.8 μm were obtained in the same manner as that for the toner particles 3' except that the amount of the black powder A' was changed from 10 parts to 20 parts, and the amount of the linear polyester was changed from 89.5 parts to 79.5 parts. A volume-specific resistance value of the particles was $2.6\times10^{14}$ Ω·cm.

Toner Particles 5'

Black toner particles 5' having $d_{50}$=7.5 μm were obtained in the same manner as that for toner particles 1' except that the C.I.Pigment Blue 15:3 was not added. A volume-specific resistance value of the particles was $5.6\times10^{4}$ Ω·cm.

| <Toner Particles 6'> Composition | |
|---|---|
| Linear polyester (a linear polyester produced from terephthalic acid/adduct of bisphenol A and ethylene oxide/adduct of bisphenol A and propylene oxide/cyclohexane dimethanol: Tg = 70° C., Mn = 4,600, Mw = 38,000, acid value = 11, hydroxy value = 23) | 83 parts |
| Carbon black (BPL produced by Cabot) | 10 parts |
| Low molecular weight polyethylene | 7 parts |

A mixture of the above composition was preparatorily mixed, kneaded with an extruder, milled with a jet mill, and classified with a pneumatic classifier to obtain black toner particles 6' having $d_{50}$=8.3 μm. A volume-specific resistance value of the particles was $4.6\times10^{14}$ Ω·cm.

Toner Particles 7'

Black toner particles 7' having $d_{50}$=8.7 μm were obtained in the same manner as that for the toner particles 1' except that the black powder A' was replaced with the black powder C'. A volume-specific resistance value of the particles was $2.5\times10^{14}$ Ω·cm.

Toners 1' to 7'

1.0 parts of negatively charged silica and 0.6 parts of negatively charged titania were added to 100 parts of the respective resultant toner particles to obtain toners 1' to 7' in which the external additives were added outside the toner.

Examples 1' to 8', Comparative Examples 1' to 5'

The toner particles 1' to 7' and the carriers A and B obtained above were used and tested as shown in Table 2. Specifically, 8 parts of the respective toners in which external additives were included were added to 100 parts of the respective carriers and mixed to obtain the developers for use in Examples 1' to 8' and Comparative Examples 1' to 5'.

The obtained developers were evaluated for the parameters shown in Table 2. Since an appropriate image could not be obtained with the developer in Comparative Example 3', the developer could not be evaluated for color coordinates, amount of charge, amount of charge after being left overnight, and high background.

Initial Electric Resistance Value of Carrier

An initial electric resistance value of the carrier was determined by measuring a resistance of the magnetic brush developer layer for a unit length in a longitudinal direction of the sleeve as described above.

Density of Solid Image

After a 1000-sheet copying test was performed under the conditions of humidity of 85% and temperature of 28° C. using a commercially available copier (A-Color630 manufactured by Fuji Xerox Co., Ltd.), density of the solid image in the 1000th copy was measured using X-Rite938 (light source:$D_{50}$, field of vision: 2 degrees).

Color Coordinates

After a 1000-sheet copying test was performed under the conditions of humidity of 85% and temperature of 28 C. using a commercially available copier (A-Color630 manufactured by Fuji Xerox Co., Ltd.), the solid image obtained by adjusting a development bias so that the amount of toner forming the solid image on a transfer member (such as paper) would be 1×d g/m$^2$[wherein d represents a volume average particle diameter (μm) of the toner particles to be used] was measured for color ordinates as described above.

Amount of Charge after 1000-Sheet Printing, Amount of Charge After Being Left Overnight, and High Background After a 1000-sheet copying test for each developer was performed under the conditions of humidity of 85% and temperature of 28° C. using a commercially available copier (A-Color630 manufactured by Fuji Xerox Co., Ltd.), the respective developers were sampled and measured for the amount of charge. The copier was left unused overnight. The following day, respective developers were sampled and measured for the amount of charge again. The first copy was found to have high background. The amount of charge was measured using TB200 (manufactured by Toshiba). The occurrence of high background was examined visually.

Amount of Charge after 30000-Sheet Printing, Amount of Charge After Being Left Overnight, High Background After a 30000-sheet copying test for each developer was performed, the respective developers were sampled and measured for the amount of charge. The copier was left unused overnight. The following day, respective developers were sampled and measured for the amount of charge again. The first copy was found to have high background. The amount of charge was measured using TB200 (manufactured by Toshiba). The occurrence of high background was examined visually.

TABLE 2

| | | | | | | | | After 1000-sheet Test | | | After 30000-sheet Test | | |
|---|---|---|---|---|---|---|---|---|---|---|---|---|---|
| | Toner | Carrier | Initial Electric Resistance of Carrier (Ω) | Color Coordinates L* | a* | b* | Solid Image Density | Amount of Charge (μC/g) | Amount of Charge After Being Left Overnight (μC/g) | High Back-ground | Amount Of Charge (μC/g) | Amount Of Charge After Being Left Overnight (μC/g) | High Back-ground |
| Ex. 1' | Toner 1' | A | $1.8 \times 10^5$ | 16.3 | 2.1 | 1.0 | 1.65 | −23.5 | −22.0 | Not Observed | −18.8 | −17.5 | Not Observed |
| Ex. 2' | Toner 2' | A | $5.8 \times 10^9$ | 16.4 | 2.3 | 1.1 | 1.55 | −30.1 | −28.3 | Not Observed | −26.3 | −23.8 | Not Observed |
| Ex. 3' | Toner 3' | A | $3.1 \times 10^7$ | 16.3 | 3.0 | 2.3 | 1.60 | −26.8 | −25.1 | Not Observed | −23.2 | −22.5 | Not Observed |
| Ex. 4' | Toner 4' | A | $9.2 \times 10^{10}$ | 13.3 | 2.5 | 1.8 | 1.52 | −32.8 | −31.5 | Not Observed | −26.5 | −24.5 | Not Observed |
| Ex. 5' | Toner 1' | B | $2.8 \times 10^8$ | 16.0 | 2.0 | 1.0 | 1.63 | −25.3 | −24.8 | Not Observed | −23.8 | −22.5 | Not Observed |
| Ex. 6' | Toner 2' | B | $7.1 \times 10^{13}$ | 16.5 | 2.2 | 1.0 | 1.53 | −34.1 | −33.3 | Not Observed | −31.5 | −30.8 | Not Observed |
| Ex. 7' | Toner 3' | B | $2.1 \times 10^9$ | 16.5 | 3.0 | 2.4 | 1.60 | −27.1 | −25.4 | Not Observed | −25.1 | −22.9 | Not Observed |
| Ex. 8' | Toner 4' | B | $4.5 \times 10^{14}$ | 13.1 | 2.3 | 1.6 | 1.52 | −33.5 | −32.1 | Not Observed | −30.0 | −28.6 | Not Observed |
| Com. Ex. 1' | Toner 5' | A | $1.1 \times 10^8$ | 12.9 | 5.3 | 4.7 | 1.58 | −27.8 | −26.5 | Not Observed | −24.8 | −23.3 | Not Observed |
| Com. Ex. 2' | Toner 6' | A | $7.6 \times 10^5$ | 12.8 | 0.9 | 1.1 | 1.85 | −24.6 | −20.3 | Not Observed | −20.5 | −15.8 | Observed |
| Com. Ex. 3' | Toner 7' | A | $5.1 \times 10^6$ | — | — | — | 1.41 | — | — | — | — | — | — |
| Com. Ex. 4' | Toner 5' | B | $4.7 \times 10^9$ | 13.0 | 5.2 | 4.6 | 1.55 | −28.9 | −27.3 | Not Observed | −25.4 | −31.1 | Not Observed |
| Com. Ex. 5' | Toner 6' | B | $3.0 \times 10^8$ | 12.6 | 0.8 | 1.0 | 1.85 | −25.5 | −21.8 | Not Observed | −20.8 | −16.1 | Observed |

Figure 2:
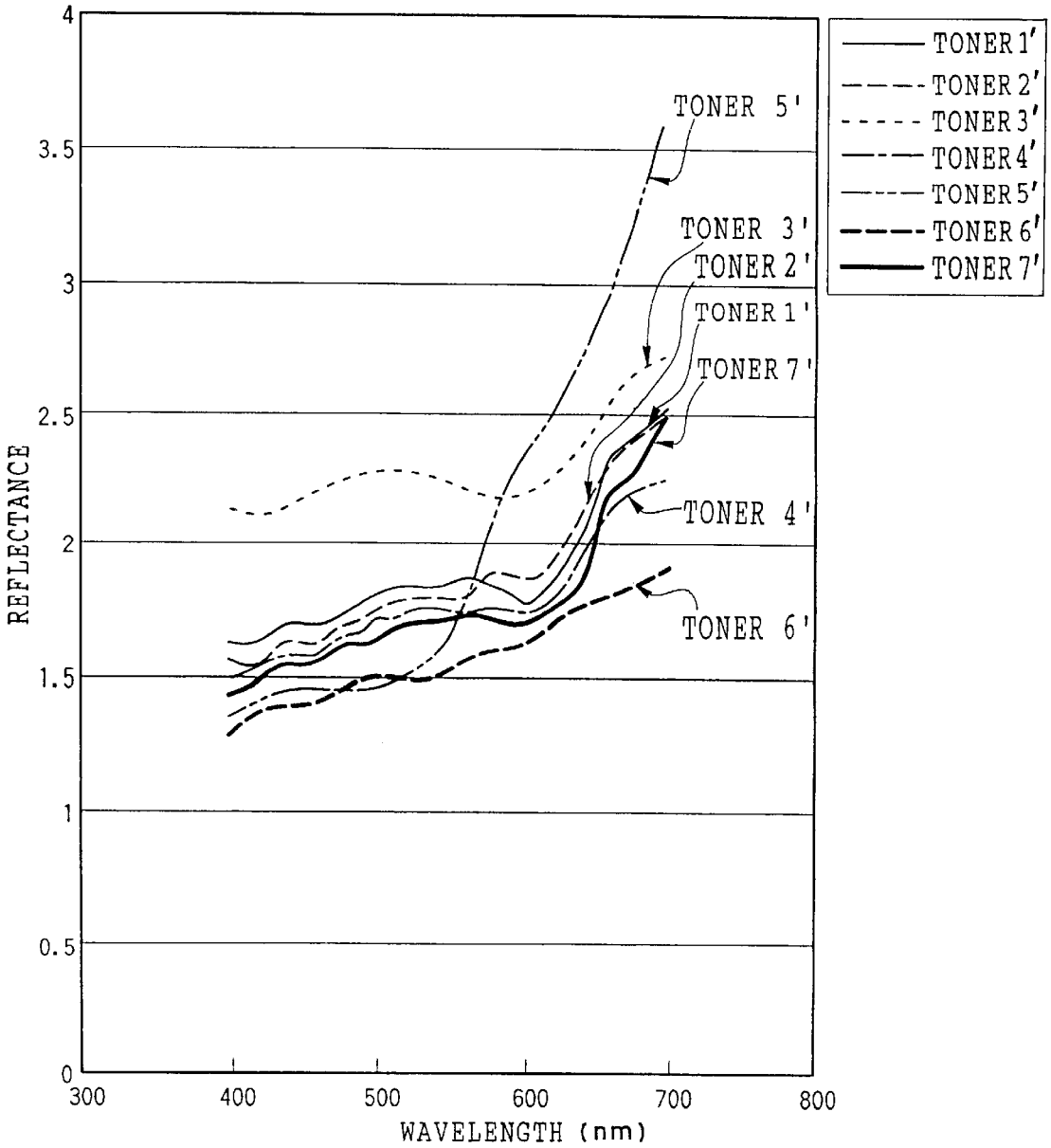
FIG. 2 is a graph showing spectral reflectances of solid images formed with the toners 1' to 7' in the Examples.

For each of the resultant developers (containing each of the toners 1' to 7'), a 1000-sheet copying test was performed under the conditions of humidity of 85% and temperature of 28° C. using a commercially available copier (A-Color630 manufactured by Fuji Xerox Co., Ltd.). Then, spectral reflectance of a solid image in the 1000th copy was measured (see FIG. 2).

In these Examples and Comparative Examples, as can be seen from spectral reflectance of the solid portions in the fixed image, the toners 1' to 4' exhibited similar reflectance in a wavelength range from 400 to 700 nm and they had a satisfactory black hue, and reproducibility of the solid portion and a halftone portion was good in the long-term copying test. Further, the toners 1' to 4' retained stable amounts of charge.

On the other hand, the toner 5' showed an increase in spectral reflectance in the wavelength region above 550 nm and exhibited a dark brown hue, thus failing to achieve a desired hue. The toner 6' had a satisfactory black hue, however, the amount of charge was largely decreased when it had been left overnight after the 30000-sheet copying test using the copier, and high background was observed in the copy. The amount of charge of the toner 7' was not so large, however, the amount used for development and image density were low, revealing that the toner 7' produced a poor quality image.

Therefore, it can be seen that a high quality black image can be obtained without causing high background by using the electrophotographic toner produced using the above-specified metal oxide as the colorant and assigning color coordinates within the specified range. Further, it can be seen that reproducibility of solid portions and halftone portions are good and a high quality image can be obtained.

As described above, according to the present invention, there are provided an electrophotographic black toner which has a high volume-specific resistance value, achieves a sufficient degree of blackness, is less likely to cause high background, and produces a high quality image, as well as an electrophotographic developer and an image forming method using said electrophotographic black toner.

What is claimed is:

1. An electrophotographic black toner comprising a colorant and a binder resin, wherein the toner contains as the colorant a metal oxide in an amount of up to 20% by weight and a pigment, said metal oxide having magnetization of 40 emu/g or smaller, said pigment having a maximum peak of spectral reflectance in a range that excludes 600 to 700 nm, and said toner has color coordinates such that L* has a value of 10 to 25, a* has a value of −3.0 to 3.0, and b* has a value of −3.0 to 3.0 as determined by a fixed image formed with the toner.

2. The electrophotographic black toner as claimed in claim 1, wherein the metal oxide has magnetization of 30 emu/g or smaller.

3. The electrophotographic black toner as claimed in claim 1, wherein the fixed image has color coordinates such that L* has a value of 10 to 24, a* has a value of −2.5 to 2.0, and b* has a value of −2.5 to 2.0.

4. The electrophotographic black toner as claimed in claim 1, wherein the metal oxide has a volume-specific resistance value of $10^5$ Ω·cm or higher.

5. The electrophotographic black toner as claimed in claim 1, wherein the metal oxide has an average particle diameter of 0.02 to 0.5 μm.

6. The electrophotographic black toner as claimed in claim 1, wherein the metal oxide is a magnetite particles or a particles having a hematite structure.

7. The electrophotographic black toner as claimed in claim 1, wherein the toner contains a metal oxide as the colorant in an amount of 5% to 20% by weight.

8. The electrophotographic black toner as claimed in claim 1, wherein the toner contains the pigment in an amount 0.1 to 2.0% by weight.

9. The electrophotographic black toner as claimed in claim 1, wherein the toner contains a pigment which has a maximum peak of spectral reflectance in a range of 400 to 500 nm.

10. The electrophotographic black toner as claimed in claim 1, wherein the particles having a hematite structure contain manganese in an amount of 5 to 40% by weight.

11. An electrophotographic developer comprising an electrophotographic black toner and a carrier, said toner comprising a colorant and a binder resin, wherein the toner contains as the colorant a metal oxide in the amount of up to 20% by weight and a pigment, said metal oxide having magnetization of 40 emu/g or smaller, said pigment having a maximum peak of spectral reflectance in a range that excludes 600 to 700 nm, and said toner has color coordinates such that L* has a value of 10 to 25, a* has a value of −3.0 to 3.0, and b* has a value of −3.0 to 3.0 as determined by a fixed image formed with the toner.

12. The electrophotographic developer as claimed in claim 11, wherein the electrophotographic developer has an electric resistance value of $6.2\times10^{4}$ to $1.0\times10^{13}$ Ω under an electric field intensity of 2.0 V/μm.

13. The electrophotographic developer as claimed in claim 11, wherein the metal oxide has a volume-specific resistance value of $10^{5}$ Ω·cm or higher.

14. The electrophotographic developer as claimed in claim 11, wherein the metal oxide is a magnetite particles or a particles having a hematite structure.

15. The electrophotographic developer as claimed in claim 11, wherein the toner contains a metal oxide as the colorant in an amount of 5% to 20% by weight.

16. An image forming method comprising: a charging step for charging the surface of a latent image holding member; an exposing step to form an electrostatic latent image on the latent image holding member; a developing step for developing the electrostatic latent image with a developer on a developer holding member to form a toner image; a transferring step for transferring the toner image onto a transfer member; and a fixing step for fixing the toner image to the transfer member;

wherein the developer comprises an electrophotographic black toner comprising a colorant and a binder resin, wherein the toner contains as the colorant a metal oxide in an amount of up to 20% by weight and a pigment, said metal oxide having magnetization of 40 emu/g or smaller, said pigment having a maximum peak of spectral reflectance in a range that excludes 600 to 700 nm, and said toner has color coordinates such that L* has a value of 10 to 25, a* has a value of −3.0 to 3.0, and b* has a value of −3.0 to 3.0 as determined by a fixed image formed with the toner.

17. The image forming method as claimed in claim 16, wherein the electrophotographic developer has an electric resistance value of $6.2\times10^{4}$ to $1.0\times10^{13}$ Ω under an electric field intensity of 2.0 V/μm.

18. The image forming method as claimed in claim 16, wherein the metal oxide has a volume-specific resistance value of $10^{5}$ Ω·cm or higher.

19. The image forming method as claimed in claim 16, wherein the metal oxide is a magnetite particles or a particles having a hematite structure.

20. The image forming method as claimed in claim 16, wherein the toner contains a metal oxide as the colorant in an amount of 5% to 20% by weight.

* * * * *